United States Patent [19]

Terhune

[11] 3,945,763

[45] Mar. 23, 1976

[54] ROTATING LEVER-ACTUATED PUMPING APPARATUS

[76] Inventor: George E. Terhune, 519 Yates St., Gainesville, Tex. 76240

[22] Filed: Apr. 29, 1974

[21] Appl. No.: 464,973

[52] U.S. Cl. ..... 417/211; 417/322; 417/462

[51] Int. Cl.[2] ..... F04B 23/04; F04B 41/06

[58] Field of Search ..... 417/462, 328, 329, 211; 418/187

[56] References Cited

UNITED STATES PATENTS

| | | | |
|---|---|---|---|
| 1,000,305 | 8/1911 | Smith | 417/462 X |
| 1,435,462 | 11/1922 | Gerling | 417/328 X |
| 2,879,713 | 3/1959 | Pelladeau | 418/187 |

FOREIGN PATENTS OR APPLICATIONS

| | | | |
|---|---|---|---|
| 275,274 | 6/1914 | Germany | 417/462 |

*Primary Examiner*—C. J. Husar
*Assistant Examiner*—Richard E. Gluck
*Attorney, Agent, or Firm*—Dunlap & Codding

[57] ABSTRACT

An improved pumping apparatus featuring a rotating frame having lever-actuated pump assemblies located thereabout. The levers are weighted at their distal ends and pivot about fixed fulcrum points as the frame rotates. The proximal ends of the levers are spur gears that engage and reciprocate a pump rod of each pump assembly via a rack gear portion of the pump rod. Pistons disposed in pump cylinders are connected to ends of the pump rods, and these pistons apply pumping force to a fluid, the fluid being communicated to the pump cylinders via conduit means that communicate with external fluid sources through an annulus pipe, and through an interdisposed inner pipe, these pipes also serving as the axle support for the frame.

12 Claims, 3 Drawing Figures

ROTATING LEVER-ACTUATED PUMPING APPARATUS

BACKGROUND OF THE INVENTION

1. Field of Invention

This invention relates generally to improvements in energy-imparting systems and more particularly, but not by way of limitation, to rotary fluid pumps. 2. Brief Description of Prior Art There have been many devices conceived and taught with the view of providing a pump wherein the lifting power is supplied by weighted members that are caused to move under the influence of gravitational force. These generally have met with limited success due to several factors, but largely relating to limitations of the apparatus.

Prior art devices have in some manner attempted to exploit the potential energy of a partially restrained weight moved by the continuing displacement of its position on a power rotated frame. As with all mechanical devices, efficiency is a dominating consideration, and none of the prior art devices have to date provided an efficient means of transferring the derived power of gravitationally moved weights to a pumped media, namely to a compressible or non-compressible fluid.

Several prior art devices may be found in the patents to Gerling, U.S. Pat. No. 1,408,188; Code, U.S. Pat. No. 734,303; Smith, U.S. Pat. No. 1,000,305; Johnson, U.S. Pat. No. 2,083,847; Anabale, U.S. Pat. No. 272,616; and Golle, U.S. Pat. No. 1,370,305.

Summary of Invention

The present invention contemplates a fluid pumping apparatus that features a frame rotatable about its axle having a plurality of levers that are pivotally connected by fulcrum shafts to the frame. Each lever is connected to its respective fulcrum shaft near a proximal end of the lever, and a weight is attached to each of the levers at the distal end of the lever. The proximal end, in the preferred embodiment, has the shape of a spur gear that powers a pump assembly through gearing engagement with a pump rod having a rack gear portion. Connected to the ends of the pump rod are pistons that are slidingly disposed in pumping cylinders. Conduit means and valve means are provided whereby fluid is provided to the pump cylinders and the energy of the reciprocating pump rods and pistons is imparted to the fluid.

An object of the present invention is to provide a rotatable, lever actuated pumping apparatus capable of efficiently imparting the energy of gravitationally influenced weights to a pumped fluid.

Another object of the invention is to provide a rotatable, lever actuated pumping apparatus that utilizes the power amplification of the lever and fulcrum principle of physics.

Another object of the present invention is to provide a rotatable, lever actuated pumping apparatus that achieves the above objects in a highly compact apparatus.

Another object of the present invention is to provide a rotatable, lever actuated pumping apparatus that will achieve the above objects with economy of construction, operation and maintenance.

Other objects and advantages of the present invention will be evident from the following detailed description when read in conjunction with the accompanying drawings which illustrate an embodiment of the invention.

A Brief Description of the Drawings

A Detailed Description of the Preferred Embodiment of the Invention

Figure 1:
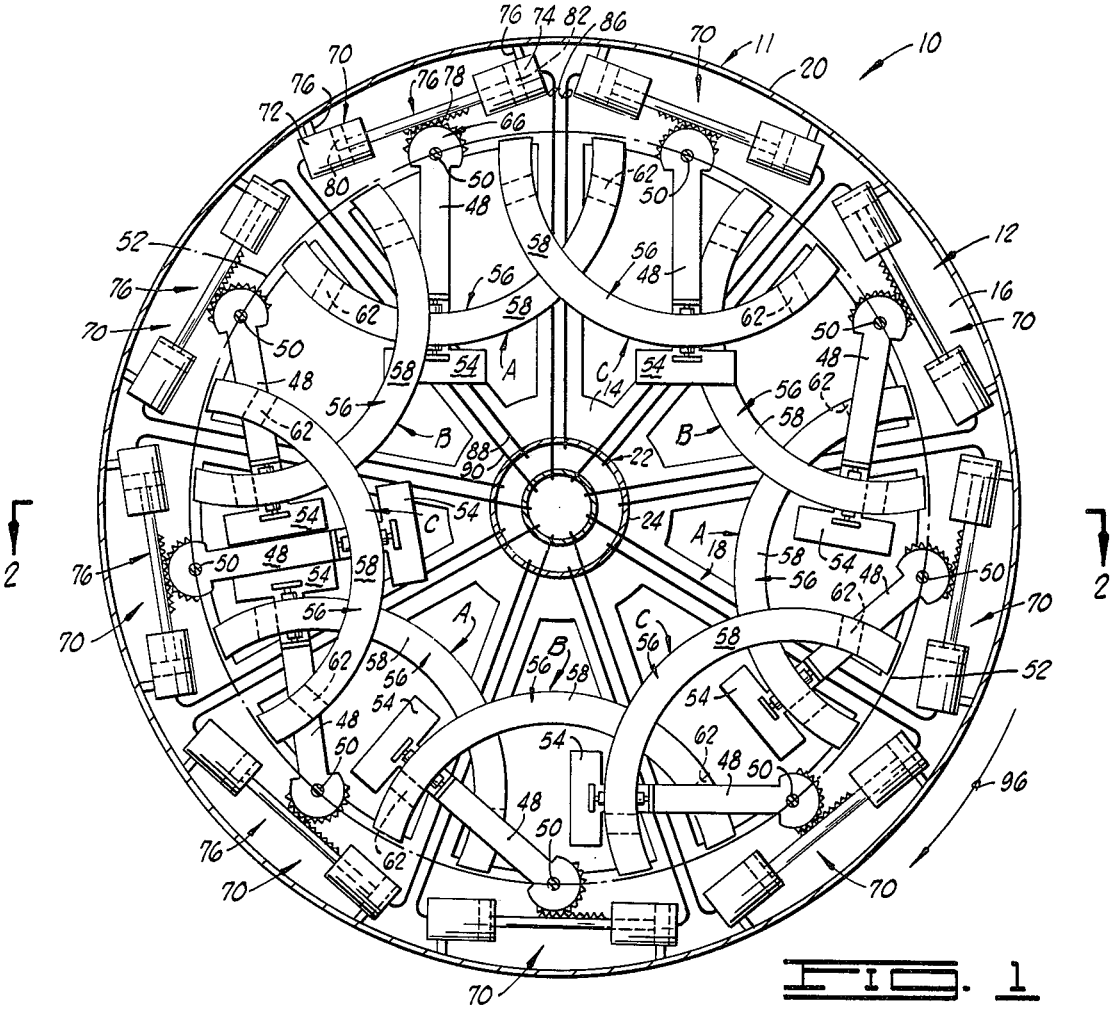
FIG. 1 is a semi-diagrammatical representation of the apparatus of the present invention, and is a cross sectional representation taken at 1—1 in FIG. 2.
Figure 2:
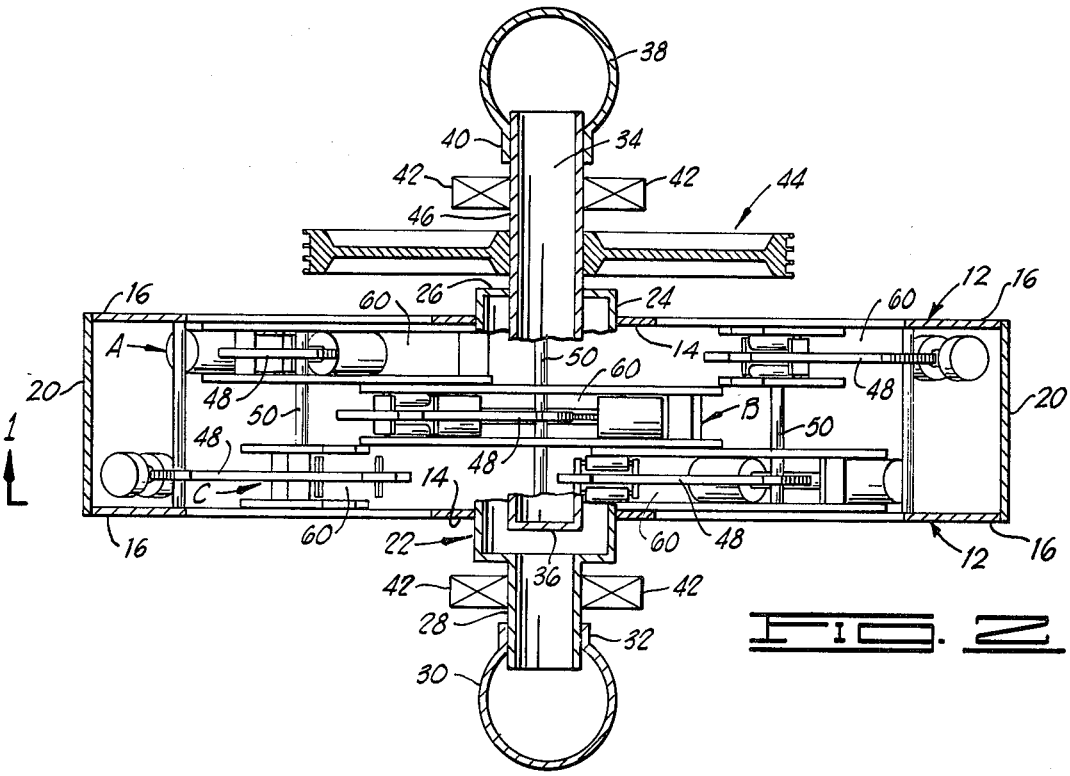
FIG. 2 is a semi-diagrammatical representation of the present invention shown in plan view as taken at 2—2 of FIG. 1.

Referring to the drawings in general, and in particular to FIG. 1, a semi-diagrammatical representation of the rotatable, lever actuated pumping apparatus of the present invention is generally designated by the numeral 10. Shown therein is a portion of a generally cylindrical frame 11 that comprises a pair of circular, generally parallel plates 12 (only one of which is shown in FIG. 1). Each of the plates 12 has a hub portion 14, a peripheral portion 16, and interconnecting spoke members 18. A perimeter plate 20 is attached normal to the outer edge of peripheral portion 16 and joins the two circular plates 12, as shown in FIG. 2. The preferred embodiment has two of the plates 12 in parallel spacial relationship, one of these plates being removed in the representation shown in FIG. 1. The plates 12 together with the perimeter plate 20 comprise the rotatable frame 11 in the present invention.

Connected through the hub portion 14 and normal to the plates 12, is the axle 22 about which the apparatus rotates. Axle 22 comprises an annulus pipe 24 that runs through and is connected to each of the plates 12, as best can be seen in FIG. 2. Annulus pipe 24 has an end plate 26 and converges to a bearing portion 28. Shown in FIG. 2 in cross section is a stationary fluid header 30. The bearing portion 28 extends into header 30 through an appropriately sized aperture and is sealed by conventional methods as by ring seal 32. As will become clear below, bearing portion 28 rotates with the frame 11 and serves as an input conduit for fluid communication from header 30.

Extending through the end plate 26 and partially disposed within annulus pipe 24 is the inner pipe 34 which is sealed from communication with annulus pipe 24 by means of end plate 36. Located at the other end of inner pipe 34 is a stationary output collector 38. As was described for the bearing portion 28, the inner pipe 34 extends into an appropriately sized aperture in the collector 38 and has a ring seal 40 of the same structure as the ring seal 32. The inner pipe 34 serves to provide fluid communication for the fluid output of apparatus 10.

From the structure viewed in FIG. 2, it is seen that the weight of the apparatus is borne on bearing blocks 42. These blocks 42 are conventional and need not be described herein for purposes of disclosure. It is sufficient to state that the bearing blocks 42 hold the weight of apparatus 10 while permitting rotation relative thereto. As will be clear from the following discussion, the present invention contemplates that the apparatus 10 is oriented so that the plates 12 lay in generally vertical planes relative to the earth's surface. The purpose of this of course is to properly harness the gravitational forces with maximum vector application on the weights, which will be described shortly.

Affixed to the axle 22, at a convenient location, is the power applicator wheel 44, shown in FIG. 2 attached to the external portion 46 of inner pipe 34. More detail is not necessary, other than to indicate that conventional power means is applied to rotate apparatus 10. For example, this may be accomplished by endless belts connected to the power wheel 44 and to the pulley of an electrical motor of appropriate size.

To this point in the disclosure, it has been established that the apparatus 10 comprises a cylindrical frame 11 that is made up of the parallel, circular plates 12 affixed to, and horizontally rotatable on, the axle 22 by means of an external source turning the power wheel 44. Attention now will be turned to the use of rotating frame 11 for the purpose of pumping a fluid.

Shown in FIG. 1 are plurality of weighted levers 48. Each of the levers 48 is bearingly connected to the plates 12 on a fulcrum shaft 50 that extends between the plates 12, as shown in FIG. 2. It will be understood that bearing means, not shown, are provided to facilitate the pivotation of the levers 48 on fulcrum shafts 50. As shown in FIG. 2, the levers 48 are variously placed on the fulcrum shafts 50 so as to form tiers of displacement so that the swinging levers will not interfere with each other during their travel, or sweep.

As shown in FIG. 1, all of the fulcrum shafts 50 are equidistantly spaced from the center of plate 12 on a reference circle 52 which is concentric about that center. This placement serves to generally balance the weight of the apparatus 10 about its rotational center, although the shifting weights described below cause a continuous offsetting, thereby biasing the frame 11.

Shown as 54 in FIG. 1 are weights attached to each of the levers 48 at the ends distal to the fulcrum shaft or points 50. The various orientations of the levers 48 in FIG. 1 are effected by the gravitational influence upon the weights 54 as each weight seeks to come to a low point in its sweep under the influence of gravitational pull.

Although not essential to the present invention, it is advisable to provide the arcuate guides 56 that comprise a pair of curved plates 58 weldingly connected to the plates 12 in parallel planar displacement so as to define the space 60 wherein the levers 48 travel or sweep. Near the ends of the guides 56 are placed shock stops 62 which are merely thick plates of metal or an elastomeric material disposed in space 60 and attached to both of the plates 58 in an apparent manner. These are represented by the dash lines shown in FIG. 1.

At the other end of each of the levers 48, opposite the distal end to which the weights 54 are attached, the ends of the levers 48 proximal to the fulcrum shaft 50, have the shape of spur gears 66, the gear teeth of which are equidistantly spaced relative to the pivot point 50.

Guide rollers 63 are mounted on the levers 48 to keep the swing of the levers 48 evenly spaced within the space 60. These rollers 63 are of conventional design and are represented in semi-detail in FIGS. 1 through 3. These bear against the guide plates 58 and serve to assure that the sweep of the levers 48 is maintained true. While not essential to the invention herein, this feature plays an important part in minimizing shock created by weight resonance and the like.

It should be noted that the placement of a lever 48 on one of the fulcrum shafts 50 determines the position of the lever relative to the plates 12. This provides tiers A, B and C that overlap as shown in FIGS. 1 and 2. Tiers A and C are disposed near each of the plates 12, while tier B is an intermediate position therebetween as can be more readily understood by referring to FIG. 2. For illustration purposes only, the embodiment of the invention shown as apparatus 10 has been shown with nine levers 48 and guides 56, with three of the levers and guides in tier A, three in tier B, and three in tier C. This is illustrative only, and the purpose here is to disclose the principle of overlapping tiers to achieve compactness of the apparatus 10, having a maximum number of weighted levers available in a minimum amount of space.

In the semi-diagrammatical views of FIGS. 1 and 2, the attachment of guide plates 58 to the peripheral portion 16 of plates 12 may not be apparent. However, it is sufficient to say that these are attached by cross braces that span between the plates 12 in a conventional manner so as to position the guide plates appropriately.

Figure 3:
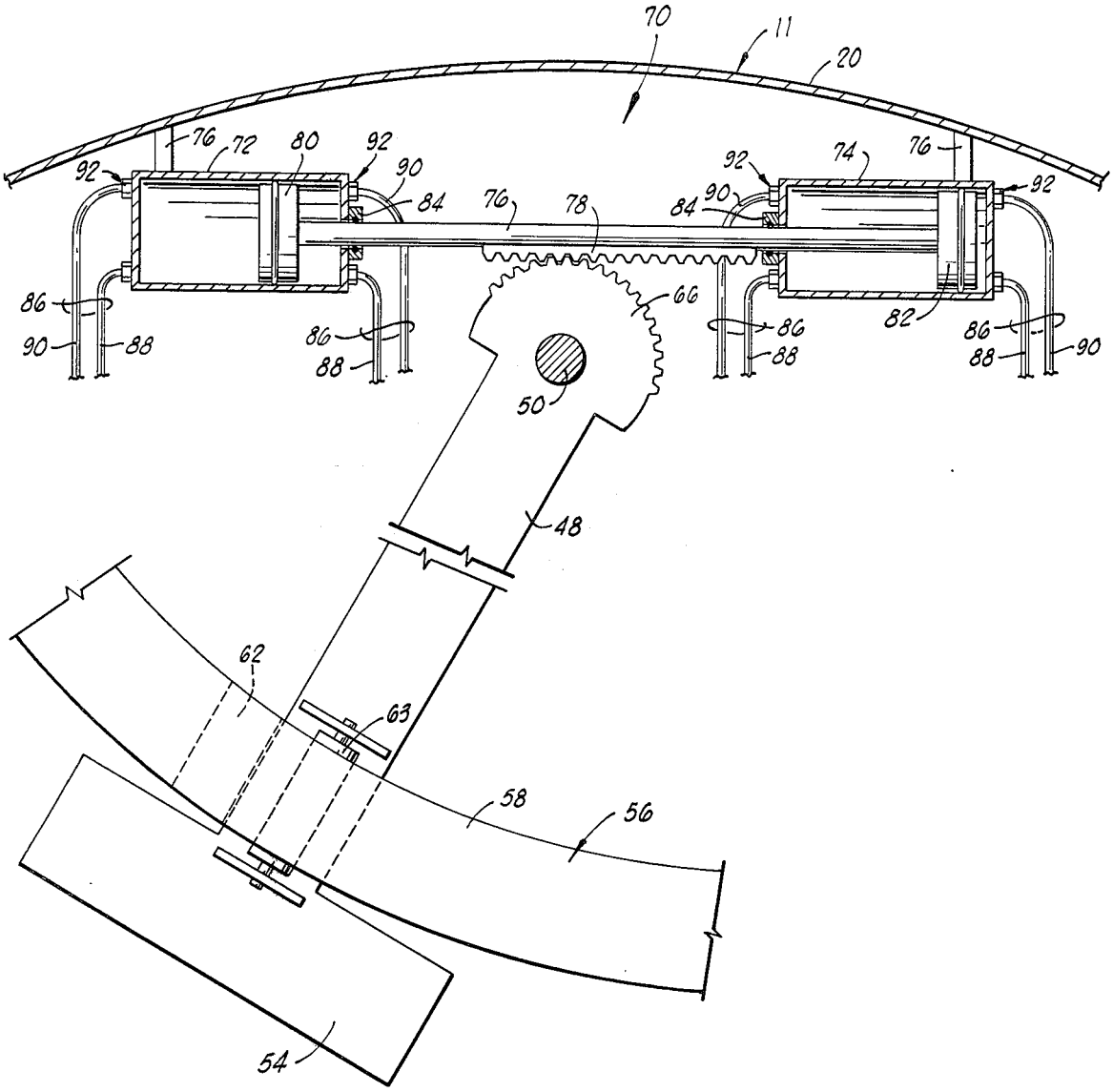
FIG. 3 is a semi-diagrammatical representation of one of the pump assemblies.

Positioned relative to each of the levers 48 is a pump assembly 70, one of which is shown in FIG. 3. The pump assembly 70 is comprised of a first pump cylinder 72 and a second pump cylinder 74, each of which is attached to the perimeter plate 20 by means of the standoffs 76. Extending between the opposing cylinders 72 and 74 is the pump rod 76 which has a rack gear portion 78. The spur gear 66 of the lever 48 is gearingly engaged with the rack gear portion 78 of the pump rod 76.

Attached to the two ends of pump rods 76 is the first piston 80 disposed in the first cylinder 72, and the second piston 82 disposed in the cylinder 74. The cylinders 72, 74 are double acting, being completely sealed except for the appropriately sized apertures to admit the extension of pump rod 76 thereinto. Of course, appropriate seals 84 of conventional design are provided to seal the cylinders from fluid leakage.

Each end of the cylinders 72, 74 are provided conduit means 86 that provide fluid communication with the ends of the cylinders to the annulus and inner pipes located at the hub of the frame 11. Each conduit means 86 comprises a fluid inlet conduit 88 and fluid outlet conduit 90. The inlet conduits 88 extend as shown and are connected with the annulus pipe 24. The outlet conduit 90 extends through the annulus pipe 24 and is connected to the inner pipe 34. While the semi-diagrammatical view shown in FIG. 1 shows the conduit means 86 extending in generally straight line fashion to the hub of the frame 11, it will be understood that these conduits may be contoured in any convenient manner in order to clear the structure of apparatus 10.

As will be understood by persons having ordinary skill in the art of pumps, valve means 92 must be provided which cooperate with the conduit means 86 to alternately permit injection and exhausting of fluid into the ends of the cylinders 72, 74 in order to complete the pumping capability of the pump assembly 70. With the reciprocation of pump rod 76, the pistons 80, 82 are caused to move back and forth in the cylinders 72, 74. Conventional valve means 92 are provided for this function and need not be described in detail for the purposes of disclosure herein. It is sufficient to indicate that there are a number of conventional ways to valve the conduit means in timed sequence with the cycling of the pistons in the cylinders so that each end of the cylinder has, in sequence, an intake cycle and an output cycle.

The apparatus described for pump assembly 70 has been that of a double acting pump for each of the cylinders 72, 74. It should be noted that each cylinder is continuously pumping so long as the pump rod 76 is reciprocating relative to the pistons.

The description of the apparatus 10 above, as complemented by the semi-diagrammatical views of FIGS. 1 through 3, has presented the basic invention herein claimed. In practice, it is contemplated that two or more of the apparatus 10 may be linked serially on the same axle.

AN OPERATION OF THE PREFERRED EMBODIMENT

The above described method of mounting pumps on the side and around the perimeter of a wheeled frame is for the purpose that they will revolve with the frame when the frame is turned by its axle. The pump assemblies are mounted such that the pump cylinders oppose each other in the assemblies. The pistons are connected by a gear driven rod that drives the pistons in the cylinders through their cyling. Pump rod reciprocation is effected by the spur gear of the proximal end of the levers pivoting about the fulcrum shafts 50. The spur gear 66 is attached to a lever having a weight on the opposite or distal end thereof. This apparatus can also be made with one cylinder instead of opposing cylinders as described above.

The reason that the pump assemblies are mounted on the perimeter plate 20 is that when the apparatus 10 is rotated, the weights on the ascending side will fall back forcing the pistons to complete a stroke, and then, when they come down the descending side of the wheel, the action will be reversed, thereupon making another stroke. This produces two strokes per revolution for each weight-lever combination. The apparatus 10 in operation is not uniformly weight balanced in that it has more weights on the ascending side than on the descending side.

As the frame 11 is rotated in the direction 96, each of the weights 54 is caused to be lifted as its fulcrum shaft is ascending, up to a point where the center of gravity of the weight is no longer supported by its respective stop 62, from which time on the weight falls through its sweep as indicated by the varying positions of the weights shown in FIG. 1.

With the sweeping motion of the lever caused by the gravitational pull on the weights 54, the spur gears 66 drivingly engage, and reciprocatingly move, the rack gear portion 78 of the pump rod 76. This action causes the pistons 80, 82 in the pump assembly 70 to pump fluid injected by the inlet conduits 88, drawing fluid from the annulus pipe 24 and feeder header 30. On the pumping cycle, fluid is pumped through the outlet conduits 90 into the inner pipe 34 to the output collector 38.

The volume of discharge and pounds per square inch from the pump assemblies 70 is predetermined and taken into account for the selection of the size of cylinder bore, length of stroke, length of the fulcrum, length of the lever, size of the weights and the number of pumps mounted. The length of the stroke and the size of the spur gear will determine the degrees of action for the lever and weights. The length of the lever determines the length of the sweep of the lever and weights. The size of the spur gear, the length of the lever and the size of the weights will determine the amount of the thrust to the pump rods and pistons.

The construction and operation of the apparatus 10 of the present invention takes advantage of the multiplying power of the fulcrum and lever principle in greatly increasing thrust transferred to the pistons. It should also be noted that the amount of energy required to operate the pumps and to raise the weights is an offsetting factor that assists in transfer of energy to the energized fluid. At the same time, this movement forces additional thrust in moving the pistons, high volume flow and/or large pressure increases possible.

For given dimensions of apparatus 10, there is a rate of rotation that is most efficient. This is the rotation that times the sweeping of the weights on the ascending side so that they will be nearing their respective stops as the gravitational effects on the weights are decreasing because of the positioning of the wheel. This will diminish or eliminate the shock of the levers striking the stops, and will provide for smooth operation of apparatus 10.

It is clear from the above description, taken in conjunction with the accompanying drawings, that the apparatus described in an improved rotatable, lever actuated pump well capable of achieving the stated objects. It will be recognized that changes may be made in the construction and in the arrangement of the parts or the elements of the embodiment disclosed herein without departing from the spirit and scope of the invention as defined in the following claims.

I claim:

1. An apparatus for pumping a fluid, comprising:
- a rotatable frame having an axle;
- bearing means rotatingly supporting said axle generally horizontally for rotation;
- a plurality of levers, each lever pivotally connected at fulcrum point on the frame removed from the axle and in close proximity to a proximal end of the lever;
- a plurality of weights, one of the weights connected to each of the levers at a distal end of the respective lever, the weights positioned for variable displacement from the center of the frame as the levers pivot on the fulcrum points; and,
- pump means engaged by the proximal ends of the levers, pumping said fluid.

2. The apparatus of claim 1 wherein:
- the axle comprises:
  - an annulus pipe having fluid communication external to the apparatus; and,
  - an inner pipe disposed in said annulus pipe and sealed therefrom, having fluid communication external to the apparatus; and,
- the pump means has fluid communication with the the annulus and inner pipes.

3. The apparatus of claim 2 further defined to include power means rotating said frame.

4. The apparatus of claim 1 wherein each lever is guided throughout its sweep by an arcuate guide.

5. An apparatus for pumping a fluid, comprising:
- a rotatable frame having an axle, the axle comprising:
  - an annulus pipe having fluid communication external to the apparatus; and,
  - an inner pipe disposed in said annulus pipe and sealed therefrom, having fluid communication external to the apparatus;
- bearing means rotatingly supporting said axle generally horizontally for rotation;
- a plurality of levers, each lever pivotally connected at a fulcrum point on the frame removed from the axle and in close proximity to a proximal end of the lever, the proximal end of each lever having the shape of a spur gear pivotal about the respective fulcrum point of the lever;

a plurality of weights, one of the weights connected to each of the levers at a distal end of the respective lever; and, a plurality of pump assemblies supported on the frame, each pump assembly powered by one of the levers and comprising:

a pump cylinder mounted on the frame;

a pump rod having a rack gear portion in reciprocating communication with the proximal end of the respective lever;

a piston slidingly disposed in the pump cylinder;

conduit means for connecting each end of the pump cylinder to the annulus pipe and to the inner pipe for fluid communication therewith and, valve means cooperating with the conduit means for providing alternating fluid communication from the annulus pipe and inner pipe to each end of the pump cylinder.

6. The apparatus of claim 1 wherein the levers are arranged in overlapping tiers.

7. A fluid-pumping apparatus comprising: a rotatable frame having an axle;

bearing means rotatingly supporting said axle;

a plurality of levers, each lever having a proximal end and a distal end, the levers pivotally connected to said frame at fulcrum points located in close proximity to the proximal ends and uniformly spaced on a reference circle concentric with the center of the circular frame, each lever having a weight connected to its distal end and the proximal end of each lever having the shape of a spur gear; and, a plurality of pump assemblies connected to the frame, each of the pump assemblies drivingly connected to one of the levers and comprising:

a first pump cylinder mounted on the frame;

a reciprocatable pump rod having a rack gear portion in driving communication with the spur gear of the proximal end of the respective lever;

a first piston slidingly disposed in the first pump cylinder for fluid pumping therein, and connected to one end of the pump rod;

first conduit means connecting each end of the first pump cylinder to an input conduit and to an output conduit; and, first valve means cooperating with first conduit means providing alternating fluid communication from each end of the first cylinder to the input conduit and to the output conduit.

8. The fluid-pumping apparatus of claim 7 wherein the pump assemblies further comprise:

a second pump cylinder mounted on the frame;

a second piston slidingly disposed in the second pump cylinder for fluid pumping therein, said second piston connected to the other end of the pump rod;

second conduit means connecting each end of the second pump cylinder to the input conduit and to the output conduit; and, second valve means cooperating with second conduit means providing alternating fluid communication from each end of the second cylinder to the input conduit and to the output conduit.

9. The fluid-pumping apparatus of claim 7 wherein the axle comprises:

an annulus pipe;

an inner pipe disposed in said annulus pipe and sealed therefrom; and, wherein the first conduit means has fluid communication with said annulus and inner pipes, said annulus pipe having fluid communication with the input conduit and said inner pipe having fluid communication with the output conduit.

10. The apparatus of claim 7 further defined to include power means rotating said frame.

11. The apparatus of claim 7 wherein each lever is guided throughout its sweep by an arcuate guide.

12. The apparatus of claim 7 wherein the levers are arranged in overlapping tiers.

* * * * *